United States Patent [19]

Eberle et al.

[11] 4,309,936

[45] Jan. 12, 1982

[54] STACKER WITH IMPROVED HYDRAULIC CYLINDER MOVEMENT

[75] Inventors: William J. Eberle, Reading; Robert J. Mills, III, Birdsboro, both of Pa.

[73] Assignee: General Battery Corporation, Reading, Pa.

[21] Appl. No.: 34,415

[22] Filed: Apr. 30, 1979

[51] Int. Cl.[3] ..... F15B 15/22

[52] U.S. Cl. ..... 91/405; 91/410; 91/448

[58] Field of Search ..... 91/404, 405, 406, 410, 91/445, 171, 27, 26

[56] References Cited

U.S. PATENT DOCUMENTS

| | | | |
|---|---|---|---|
| 1,842,725 | 1/1932 | Link | 91/405 |
| 2,380,973 | 8/1945 | Kopp | 91/171 |
| 2,508,647 | 5/1950 | Newman et al. | 91/405 |
| 2,994,303 | 8/1961 | Robra et al. | 91/27 |
| 3,732,027 | 5/1973 | Lupke | 91/410 |
| 4,066,189 | 1/1978 | Toyoaki et al. | 91/27 |
| 4,136,600 | 1/1979 | Heiser | 91/27 |

*Primary Examiner*—Paul E. Maslousky

*Attorney, Agent, or Firm*—Benasutti Associates, Ltd.

[57] ABSTRACT

An apparatus for controlling the movement of a fluid-actuated hydraulic cylinder. A pumping mechanism is provided to pump fluid into the hydraulic cylinder; and a tank receives the fluid expelled from the hydraulic cylinder. A reversing valve between said pumping means and said hydraulic cylinder means controls the flow direction of the fluid into and out of the hydraulic cylinder and a valve mechanism between the pump means and the hydraulic cylinder, and operatively connected to the hydraulic cylinder, controls the fluid flow rate into and out of the cylinder corresponding to the motion of the hydraulic cylinder. One embodiment of the invention is specifically designed to power the main drive gear of an apparatus for stacking battery plates and separators.

8 Claims, 4 Drawing Figures

STACKER WITH IMPROVED HYDRAULIC CYLINDER MOVEMENT

CROSS-REFERENCES TO RELATED APPLICATIONS

This application is related to a prior copending application, Ser. No. 701,814, filed July 1, 1976, now U.S. Pat. No. 4,168,772, entitled APPARATUS AND METHOD FOR STACKING BATTERY PLATES AND SEPARATORS, which is a continuation-in-part of Ser. No. 511,054, filed October, 1974, entitled APPARATUS AND METHOD FOR HANDLING AND STACKING BATTERY PLATES AND THE LIKE, now U.S. Pat. No. 3,982,624 dated Sept. 28, 1976. This application discloses in part the subject matter disclosed and claimed in the prior applications, and these prior applications are incorporated herein by reference.

BACKGROUND AND SUMMARY OF THE INVENTION

The present invention in general relates to an apparatus for producing a constant, linear mechanical force at varying speeds. In particular, the apparatus is adapted to produce a linear mechanical force to operate the main drive system of an apparatus for stacking battery plates and separators.

Ordinarily, when it is necessary to provide the type of varying speed linear mechanical force which is discussed herein, a piece of equipment well known in the art as a Geneva Drive is utilized. A Geneva Drive mechanism, however, is a relatively expensive structure and generally has a very complex mechanical arrangement.

It is, therefore, a basic object of the present invention to provide a simpler, less expensive and much more easily implemented arrangement which is capable of efficiently providing a motion similar to a Geneva Drive by producing periodic variations in the speed of the movement of a piston in a fluid-actuated hydraulic cylinder.

In cooperation with the fluid-actuated hydraulic piston cylinder, a pump is provided in the present invention for pumping fluid to the hydraulic piston cylinder, and a tank is provided for receiving fluid expelled during the operation of the piston cylinder. Also provided is a reversing valve for alternating the direction of fluid flow into and out of the hydraulic cylinder, and of key significance is a valve mechanism which is introduced between the pump and the hydraulic piston cylinder. This valve mechanism engages and is operated by the motion of the hydraulic piston cylinder so that the flow rate of the fluid entering the hydraulic cylinder is variably controlled in response to the movement of the hydraulic cylinder.

BRIEF DESCRIPTION OF THE DRAWINGS

Further objects and advantages of the present invention will be evident from the following detailed description read in conjunction with the drawings, wherein.

DETAILED DESCRIPTION OF THE INVENTION

Figure 1:
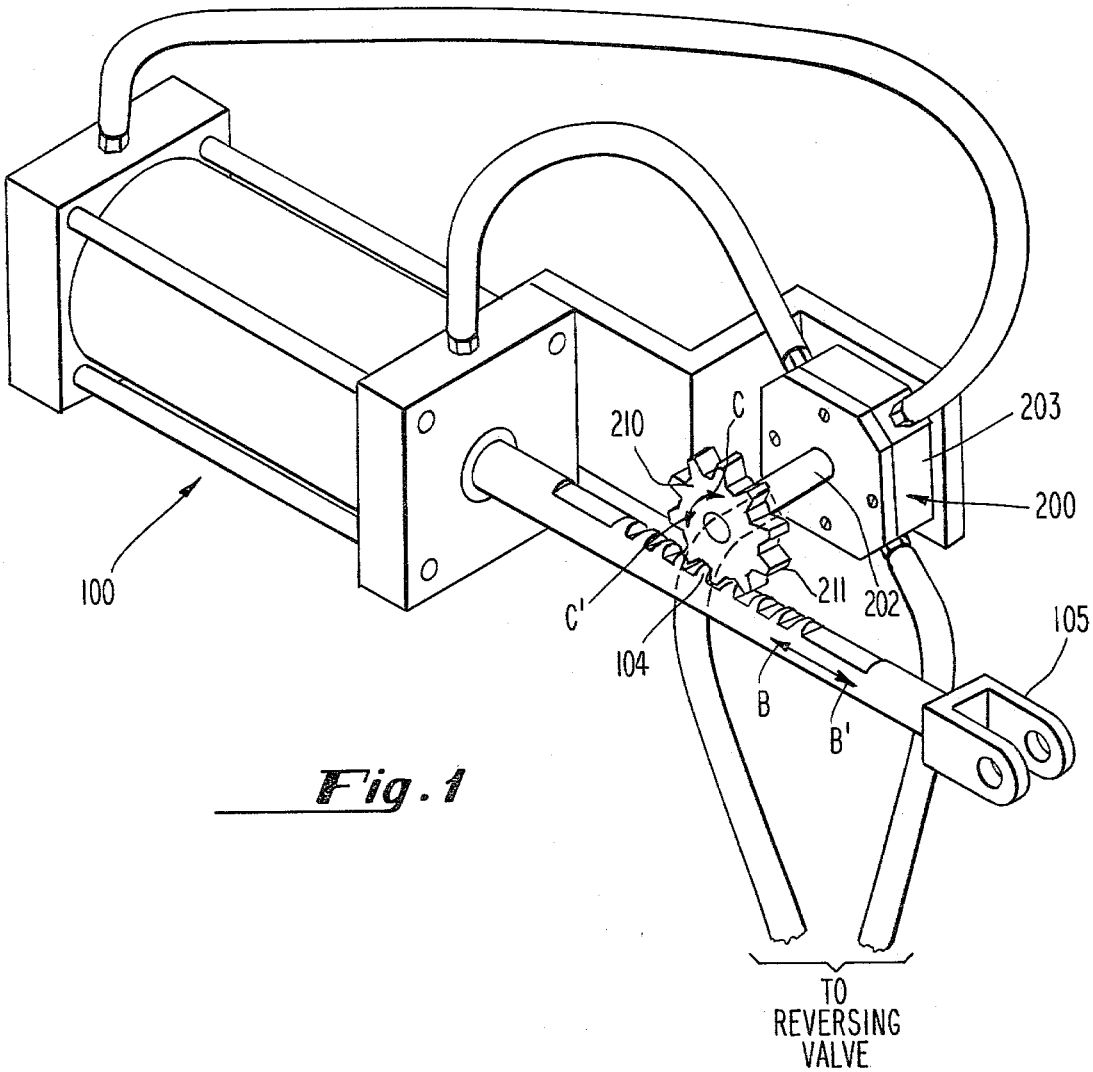
FIG. 1 is a perspective view of the hydraulic cylinder and valve mechanism of the present invention.

Although several specific forms of the invention have been selected for illustration in the drawings and the following description is drawn in specific terms for describing these forms of the invention, this description is not intended to limit the scope of the invention which is defined in the appended claims.

As shown in FIG. 1, the present invention is primarily a combination of two components, a piston cylinder 100 and a valve mechanism 200. The piston cylinder 100 is fluid-actuated, and the schematic arrangement presented in FIG. 2 discloses the connection of the cylinder 100 and the valve mechanism 200 to a pumping apparatus 300. A reversing device 400 is positioned between the pump mechanism 300 and the valve mechanism 200; the reversing device 400 regulates the flow direction and determines the flow path of the fluid between the valve mechanism and the cylinder. A storage tank 301 is provided to receive the fluid expelled from the piston cylinder 100 as a result of the piston motion therein.

The piston cylinder mechanism 100 is basically a double-acting piston cylinder wherein a piston 101 is contained within a hollow, closed-end cylinder 102. A piston rod 103 projects from the piston 101 through one of the closed ends of the cylinder. Fluid may enter or exit at either end of the cylinder to force the piston 101 in either direction within the cylinder. At the exposed end of the piston rod 103, a yoke 105 is provided so that the piston rod can be connected to whatever is to be operated thereby.

Without insertion of the valve mechanism 200 between the pump mechanism and the piston cylinder, the flow rate of the operating fluid from the pump mechanism 300 forcing against the piston inside the cylinder is constant and continuous. This constant flow rate causes the piston in the piston cylinder to move at a constant speed until some form of mechanical stop is encountered by the piston 101 or the rod 103 to halt the movement thereof, or in other words the movement of the piston is constant and unvarying until the piston stops abruptly when the mechanical stop is encountered. On the otherhand, when the valving mechanism 200 of the present invention is inserted between the pump mechanism and the piston cylinder, a distinctive means is provided which effectively varies the rate of fluid flow into and out of the cylinder, and thereby influences the resultant speed of movement of the piston so that the speed of the piston movement is not constant.

The valving mechanism 200 of this invention includes a valve member 201 mounted on a rotatable shaft 202 for rotation therewith. A fluid-tight valve housing 203 surrounds the valve member and shaft. The outer surface 204 of the valve member 201 is substantially sealed within the housing; however, the valve member is still free to rotate. The shaft 202 extends through the valve housing 203 (FIG. 1).

Hollow channels 205 and 206 are formed through the valve member 201 and are formed so as to simultaneously align with openings 207, 207' and 208, 208' in the valve housing 203. The openings 207, 207' communicate with the reversing device 400 and, additionally, the pump and tank; the openings 208, 208' communicate with the piston-cylinder mechanism 100. During rotation of the valve member 201, the channels 205, 206 move between complete or total and only partial alignment with these various openings.

Figure 2:
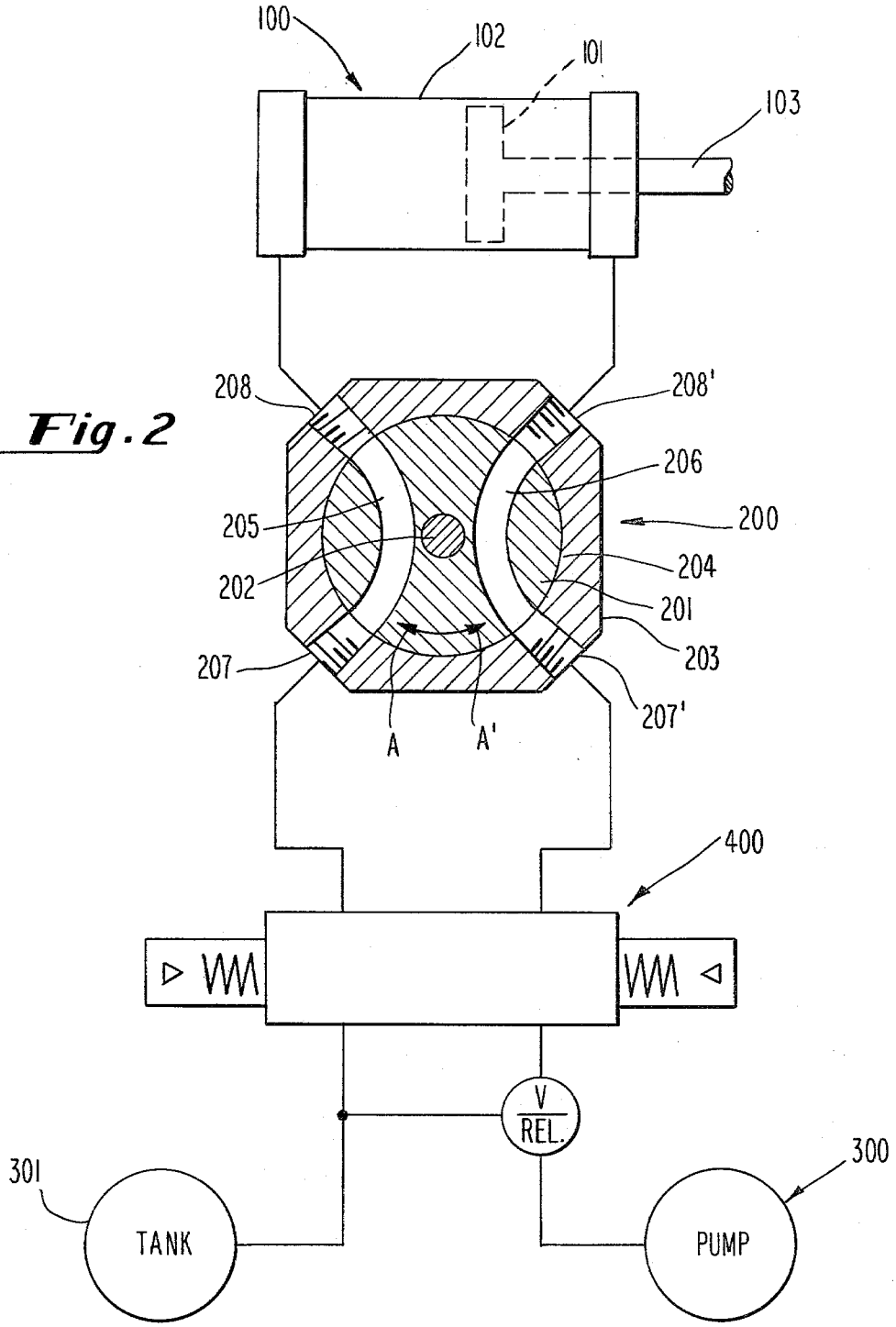
FIG. 2 is a section view of the valve mechanism assembly of the present invention in the fully open position, the valve mechanism being schematically connected to the rest of the elements of the apparatus.

The valve member 201 is free to rotate in the directions of arrows A and A' within the housing 203. When the valve member 201 is in the center position, as shown in FIG. 2, the channels 205, 206 are completely aligned with all of the openings. This is the "full open" position of the valve member, and in this position, maximum fluid flow through the channels in the valve member and the openings in the housing is attained. Constant maximum flow through the channels forces the piston 101 to move through the cylinder 102 at a constant maximum speed. This "full open" position corresponds to the structure discussed above wherein no valve mechanism was provided between the pump and the piston cylinder and wherein the piston always operated under maximum conditions.

Figure 3:
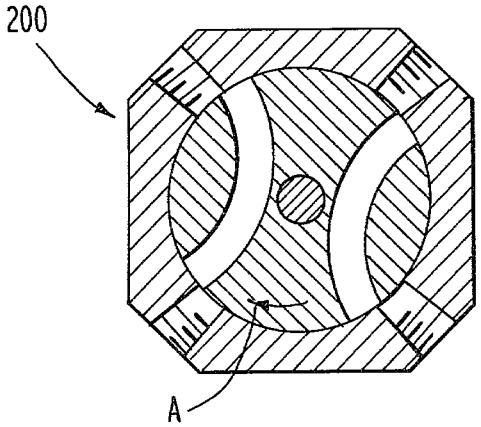
FIG. 3 is a section view of the valve mechanism of the present invention rotated clockwise.
Figure 4:
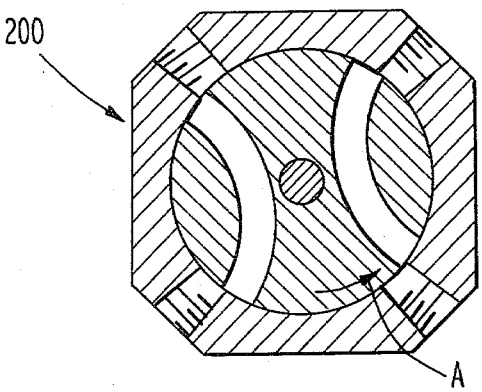
FIG. 4 is a section view of the valve mechanism of the present invention rotated counter-clockwise.

When the valve member 201 rotates in the clockwise direction (arrow A) the channels 205, 206 assume the position disclosed in FIG. 3. As seen from FIG. 3, when the valve member rotates to this clockwise position, the channels 205 and 206 move more and more out of alignment with the valve openings 207, 207' and 208, 208', thus gradually and continuously restricting the entrances and exists of the flow channels. When this happens, the flow of the fluid diminishes and the piston movement slows accordingly. A similar situation occurs when the valve member 201 rotates in the counter-clockwise direction (arrow direction A') as shown in FIG. 4. The channels 205 and 206 steadily move out of alignment with the openings; the flow paths are gradually restricted; and the amount of fluid acting on the piston slowly diminishes.

From the above considerations given to the effects on the flow which result due to the restriction caused by the non-alignment of the channels with the openings, it is possible to understand how the piston in the present invention moves at a variable speed, rather than by simply moving at a continuous, "full speed" at all times. When the valve member moves from the full, counter-clockwise position (FIG. 4) through the central position (FIG. 2) to the full clockwise position (FIG. 3), the fluid flow increases from its most restricted to "full open" or least restricted where the fastest speed is produced, and back to its most restricted where the slowest speed is produced. The amount of fluid and the speed of the piston varies with the rotation of the valve member, and consequently, the piston never comes to an abrupt stop from a full, constant speed (as would happen without the valve), but rather has its thereon speed gradually diminished by the gradual restriction of the flow openings.

It is possible to control this rotational activity of the valve member 201 by a variety of different means, but in the particular embodiment of the present invention as shown in FIG. 1, the rotational movement of the valve member is slaved or made to correspond to the linear motion or stroke of the movable piston rod 103. A series of gear teeth 104 are shown to be formed on the piston rod 103 along the upper surface thereof. Gear teeth 211 surround the circumference of a gear body 210 which is connected to the rotatable valve shaft 202 and is rotatable therewith. These gear teeth 211 cooperate with the gear teeth 104 on the piston rod, and when the piston rod moves backward and forward the gear body is caused to rotate. The representation shown in FIG. 1 is by way of example to show the cooperation of the movement of the rod 103 and the rotation of the gear body 210. In the actual arrangement, however, there would be no possibility that the gear teeth 104 on rod 103 might enter into the cylinder which from this representation appears possible during the inward movement of the rod.

As fluid from the pump begins to pass through the valve mechanism 200, enter into the cylinder 102, and force against the piston 101 from either side, the piston rod 103 moves in either the direction B or B' as shown by the arrow in FIG. 1, depending on which side of the piston the fluid enters as governed by the reversing mechanism 400. At the same time the rod 103 moves, the gear teeth 211 engaging the piston rod move the gear body 210 in either the direction C or C' as shown by the arrows. Inward movement B of the rod 103 into the cylinder 102 results in a corresponding clockwise rotation C of the gear body 201. Likewise, an outward movement B' of the rod 104, causes the gear body 210 to rotate counter-clockwise in the direction C'.

The rotation of the gear body 210 causes the shaft 202 and the valve member 201 connected thereto to rotate. As explained previously, when the valve member rotates, the alignments of the channels with the valve openings vary and, thereby, control the rate of fluid flow and the subsequent speed of the piston in the cylinder.

By arranging the various elements of the invention as described, the linear movement of the rod is translated into the rotational movement of the valve member. As a result, the amount of fluid acting up on the piston rod is variable in accordance with the linear movement of the rod, and a full fluid flow is never continuously admitted into the piston cylinder. The effect achieved by incorporating this valve mechanism is substantially the same as the Geneva Drive force discussed previously; however, the structure is much less costly and less complicated.

The reversing mechanism 400 shown schematically in FIG. 2 is any commercially available or readily known device, such as a reversing valve, which will control the fluid flow directions into and out of the valve mechanism and, ultimately, the piston cylinder.

A second embodiment of the principles and mechanisms taught herein is adaptable to the apparatus which is disclosed in copending application, Ser. No. 701, 814, filed July 1, 1976, and which has been previously incorporated herein by reference. The main driving mechanism in that invention, as shown in FIG. 10A thereof, is a cylinder and piston arrangement designated generally as 318. A rack 316 is connected to the rod of the piston arrangement 318, and the rack 316 engages a gear drive wheel 314 mounted on a central shaft 310.

By inverting the piston rod 103 of the present invention as shown herein in FIG. 1, the piston-cylinder mechanism 100 of FIG. 1 can be incorporated to rotate the drive gear of the parent application by engaging the gear teeth thereof. Furthermore, by connecting a drive chain between the gear body 210 of FIG. 1 and a separate second gear body (not shown) connected onto the shaft 310 of the parent application, the gear body 210 can be rotated as a result of the rod rotating the drive gear 314 which is connected to the central shaft 310. When the shaft 310 rotates, the second gear body rotates and that rotation is conveyed to the valve gear body 210 by the drive chain. In this manner, the linear motion of the piston rod is translated into rotary motion to rotate the valve member 210. (The remaining undiscussed features of the first embodiment remain the same when the invention is adapted for use with the device of the parent application; except the yoke 105 may be eliminated). With this specific structure incorporated into the driving mechanism of the parent application, the rotation of the drive wheel is smooth and continuous; there are no abrupt starts or stops that result from an ordinary double-acting piston cylinder.

The pumping mechanism 300 of the present invention may be any pumping device which can provide a working fluid under pressure to the piston cylinder. Any suitable working fluid may be used, such as compressed air, hydraulic fluid or any other suitable material, and the pump, of course, is selected according to the type of working fluid being used.

The tank 301 is provided to receive the fluid when it is forced form the cylinder, and a safety relief valve 500 may also be provide in the fluid system to prevent excess pressure from building up.

It will be understood that various changes in the details, materials and arrangements of the parts which have been herein described and illustrated in order to explain the nature of this invention may be made by those skilled in the art within the principle and scope of the invention as expressed in the following claims.

It will further be understood that the "Abstract of the Disclosure" set forth herein is intended to provide a non-legal technical statement of the contents of the disclosure in compliance with the Rules of Practice of the United States Patent and Trademark Office, and is not intended to limit the scope of the invention described and claimed herein.

What is claimed is:

1. An apparatus for controlling the output movement of a fluid actuated hydraulic cylinder, said apparatus comprising:

(a) pumping means for pumping a fluid into said hydraulic cylinder;

(b) reversing means between said pumping means and said hydraulic cylinder for controlling the direction of fluid flow into said hydraulic cylinder; and (c) velocity control means operatively connected to said hydraulic cylinder and responsive to the output motion of said hydraulic cylinder so as to cause a gradual acceleration at the start of said output motion and a gradual deceleration prior to the stopping of said motion;

(d) wherein said velocity control means is a valve comprising:

(i) a valve housing positioned between said pumping means and said hydraulic cylinder, said housing having a plurality of pairs of openings therethrough which communicate with both said hydraulic cylinder and said pumping means; and (ii) rotatable shaft means mounted within said valve housing and in operational association with said hydraulic cylinder, said shaft means being adapted to rotate in response to said output motion of said hydraulic cylinder and having a plurality of channels therethrough, said channels being disposed so that;

at the start of said output motion of said hydraulic cylinder said channels are substantially misaligned with said pairs of openings in said valve housing, preventing full fluid flow into said hydraulic cylinder and providing said output motion with a starting velocity having a minimum value which is substantially lower than full speed; said misalignment gradually decreasing as said shaft means rotates in response to said output motion, allowing a gradually increasing fluid flow into said hydraulic cylinder, accelerating motion of the hydraulic cylinder to a maximum speed as said channels pass through full alignment with said openings; said rotation then causing said channels to again gradually misalign with said openings so that said fluid flow gradually decreases and said output motion decelerates substantially to said minimum value just prior to the conclusion of said output motion.

2. The apparatus of claim 1 wherein said hydraulic cylinder comprises:

(a) a hollow cylinder housing sealed at both ends and adapted to receive and expel fluid from the opposite ends thereof;

(b) a piston slideably mounted within said cylinder housing; and (c) a piston rod rigidly connected to said piston and extending through one of said sealed ends of said cylinder housing, said piston rod moving with the motion of said piston and having an end portion outside of said sealed end, said end portion having a first gear tooth portion thereon.

3. The apparatus of claim 2 wherein said rotatable shaft means further comprises:

(a) a rotatable shaft member rigidly attached to said rotatable shaft means so as to rotate therewith and sealingly passing through said valve housing and disposed to extend from said valve housing towards the end portion of said piston rod of said hydraulic cylinder; and (b) second gear tooth means mounted on the end of said rotatable shaft member, said second gear tooth means being positioned to engage said first gear tooth portion of said piston rod so that linear motion of said piston rod will cause said rotatable shaft member and said rotatable shaft means to rotate and move said channels from partial to total to partial alignment with said openings through said housing.

4. The apparatus of claim 1 further comprising tank means connected to said hydraulic cylinder for receiving fluid expelled from said hydraulic cylinder and for supplying hydraulic fluid for injection into said hydraulic cylinder.

5. An apparatus for producing variably accelerated linear motion comprising:

(a) fluid actuated piston cylinder means for producing a linear movement;

(b) pumping means operatively connected to said piston cylinder means for supplying a fluid to operate said piston cylinder means;

(c) reversing means between said pumping means and said piston cylinder means for controlling the direction of said fluid flow from said pumping means into said piston cylinder means; and (d) velocity control means operatively connected between said pumping means and said piston cylinder means, and operatively connected to said piston cylinder means and responsive to the output motion of said piston cylinder means so as to cause a gradual acceleration at the start of said output motion and a gradual deceleration prior to the stopping of said motion;

(e) wherein said velocity control means is a valve comprising:

(i) a valve housing positioned between said pumping means and said piston cylinder means, said housing having a plurality of pairs of openings therethrough which communicate with both said piston cylinder means and said pumping means; and (ii) rotatable shaft means mounted within said valve housing and in operational association with said piston cylinder means, said shaft means being adapted to rotate in response to said output motion of said piston cylinder means and having a plurality of channels therethrough, said channels being disposed so that;

at the start of said output motion of said piston cylinder means said channels are substantially misaligned with said pairs of openings in said valve housing, preventing full fluid flow into said piston cylinder means and providing said output motion with a starting velocity having a minimum value which is substantially lower than full speed; said misalignment gradually decreasing as said shaft means rotates in response to said output motion, allowing a gradually increasing fluid flow into said piston cylinder means, accelerating motion of said piston cylinder means to a maximum speed as said channels pass through full alignment with said openings; said rotation then causing said channels to again gradually misalign with said openings so that said fluid flow gradually decreases and said output motion decelerates substantially to said minimum value just prior to the conclusion of said output motion.

6. The apparatus of claim 5 wherein said piston cylinder means comprises:

(a) a hollow cylinder housing sealed at both ends and adapted to receive and expel fluid from the opposite ends thereof;

(b) a piston slideably mounted within said cylinder housing; and (c) a piston rod connected to said piston and extending through one of said sealed ends of said cylinder housing, said piston rod moving with the motion of said piston and having an end portion outside of said sealed end, said end portion having a first gear tooth portion thereon.

7. The apparatus of claim 6 wherein said rotatable shaft means further comprises:

(a) a rotatable shaft member rigidly attached to said rotatable shaft means so as to rotate therewith and sealingly passing through said valve housing said shaft member extending from said valve housing towards the end portion of said piston rod of said piston cylinder means; and (b) second gear tooth means mounted on the end of said rotatable shaft member, said second gear tooth means being positioned to engage said first gear tooth portion of said piston rod so that linear motion of said piston rod will cause said rotatable shaft member and said rotable shaft means to rotate and move said channels from partial to total to partial alignment with said openings through said housing.

8. The apparatus of claim 5 further comprising tank means connected to said piston cylinder means for receiving fluid expelled from said piston cylinder means and for supplying hydraulic fluid for injection into said piston cylinder means.

* * * * *